United States Patent [19]

Kondo et al.

[11] Patent Number: 4,557,324

[45] Date of Patent: Dec. 10, 1985

[54] SERPENTINE TYPE EVAPORATOR

[75] Inventors: Hiroshi Kondo, Sano; Hiroyasu Nadamoto, Mitaka; Yoshikazu Takamatsu, Sano, all of Japan

[73] Assignee: Nihon Radiator Co., Ltd., Tokyo, Japan

[21] Appl. No.: 637,793

[22] Filed: Aug. 6, 1983

[30] Foreign Application Priority Data

Aug. 8, 1983 [JP] Japan ..... 58-122188

[51] Int. Cl.[4] ..... F28F 9/02

[52] U.S. Cl. ..... 165/174

[58] Field of Search ..... 165/174; 62/515, 527

[56] References Cited

U.S. PATENT DOCUMENTS 2,178,095 10/1939 Bowser ..... 165/174

2,852,042 9/1958 Lynn ..... 165/174 X

*Primary Examiner*—Lloyd L. King

*Attorney, Agent, or Firm*—Gordon W. Hueschen

[57] ABSTRACT

In a serpentine type evaporator comprising a serpentine tube provided therein with a plurality of coolant conduits and corrugated in a zigzag pattern, fins interposed between opposed outer surfaces of said serpentine tube, an inlet side header pipe connected to one end of said serpentine tube so as to communicate with said coolant conduits, and an outlet side header pipe connected to the other end of said serpentine tube so as to communicate with said coolant conduits, the improvement in a projection disposed within the outlet side header pipe.

7 Claims, 5 Drawing Figures

SERPENTINE TYPE EVAPORATOR

BACKGROUND OF THE INVENTION

1. Field of the Invention

This invention relates to a serpentine type evaporator for use in a space cooling cycle such as in an automotive air-conditioning system, and more particularly to improvements in and concerning a header pipe on the outlet side of the evaporator.

2. Description of Prior Art

Generally, the cooler unit of the automotive air-conditioning system incorporates therein an evaporator which forms part of the space cooling cycle.

Among the conventional evaporators of this class is counted a serpentine type evaporator constructed as shown in FIG. 1. The serpentine type evaporator comprises a serpentine tube 1 of a flat cross section containing a plurality of coolant conduits 2 and corrugated in a zigzag pattern, fins f interposed between each pair of opposed outer surfaces 3 of the serpentine tube 1, and an inlet side header pipe 4 and an outlet side header pipe 5 connected to the opposite ends of the serpentine tube 1 in such a manner that their interiors communicate with the interiors of the group of coolant conduits 2. Through the inlet side header pipe 4, the coolant which has been given decreased pressure and rendered more susceptible to evporation in an expansion valve flows into the group of coolant conduits 2 in the serpentine tube 1. During the travel through the group of coolant conduits 2 shaped in a smimlarly corrugated form, the coolant deprives the air flowing between the fins f of heat and evaporates, with the result that the heat of this evaporation cools the air. The gaseous coolant resulting from the evaporation is forwarded through the outlet side header pipes 5 into a compressor which is not shown in the diagram.

The serpentine type evaporator by nature is disposed to send off vibratory noise, though feebly, while in operation. Our investigation into the cause for this noise has uncovered the fact that at the time the coolant spurts from the coolant conduits 2 of the serpentine tube 1 into the outlet side header pipe 5, as illustrated in FIGS. 2 and 3, edge noise occurs in the neighborhood of E portion of the tube outlet end and standing current A occurs in the neighborhood of the closed end of the outlet side header pipe 5. Owing to this standing current A, the noise is generated within the outlet side header pipe of the shaped tube 1. Particularly in the case of automobiles of latest models, since their interiors are kept in deep silence by use of tight seals, it is desirable that the noise of the cooler unit including the evaporator which is installed in the automobile interior should be precluded at all cost.

An object of this invention, therefore, is to provide an improved serpentine type evaporator.

Another object of this invention is to provide a serpentine type evaporator adapted to curb the occurence of the standing current within the outlet side header pipe and consequently prevent the occurence of the resonance noise.

Yet another object of this invention is to provide an improved serpentine type evaporator to be incorporated in the space cooling cycle of the air-conditioning system as in the automobile.

SUMMARY OF THE INVENTION

The objects described above are accomplished by an improvement in a serpentine type evaporator comprising a serpentine tube provided therein with a plurality of coolant conduits and corrugated in a zigzag pattern, fins interposed between opposed outer surfaces of the serpentine tube, an inlet side header pipe connected to one end of the serpentine tube so as to communicate with the coolant conduits, and an outlet side header pipe connected to the other end of the serpentine tube so as to communicate with the coolant conduits, which improvement is a projection disposed within the outlet side header pipe.

PREFERRED EMBODIMENT OF THE INVENTION

Figure 5:
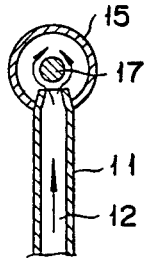
FIG. 5 is a cross-sectional view taken along the line V—V in the diagram of FIG. 4.
Figure 4:
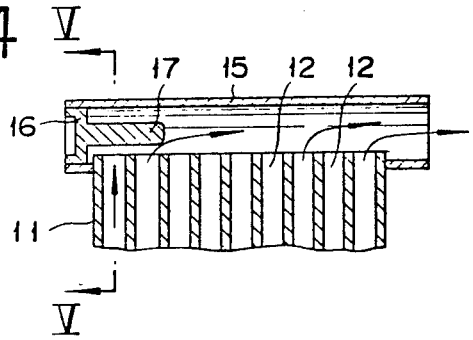
FIG. 4 is a cross-sectional view of the essential part of a typical serpentine type evaporator of this invention.

Now, one embodiment of this invention will be described below with reference to the accompanying drawing. FIGS. 4 and 5 are a longitudinal cross section and a lateral cross section, respectively, illustrating an outlet side header pipe and its vicinity in the serpentine type evaporator of the present invention.

Figure 1:
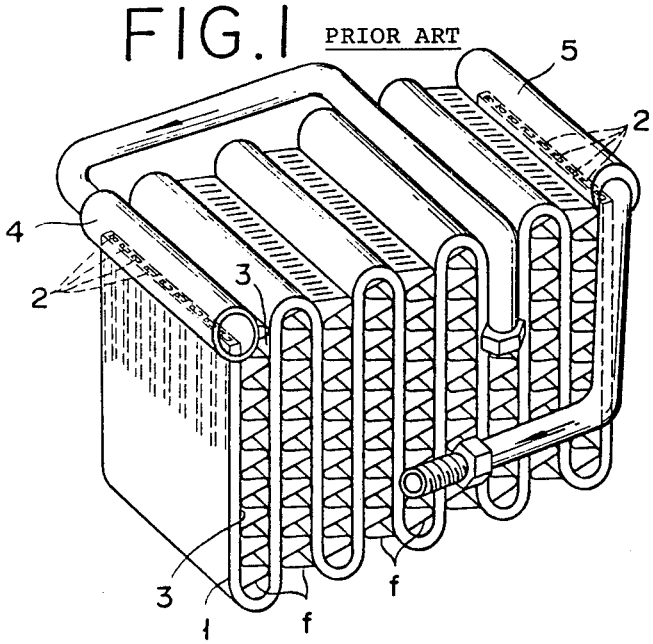
FIG. 1 PRIOR ART
FIG. 1 is a perspective view of a geneal serpentine type evaporator.
Figure 3:
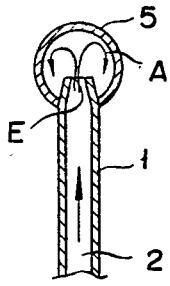
FIG. 3 is a cross-sectional view taken along the line III—III in the diagram of FIG. 2.
Figure 2:
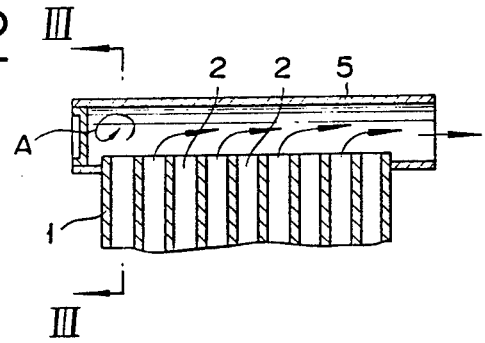
PRIOR ART FIG. 2 PRIOR ART
FIG. 2 is a cross sectional view illustrating the essential part of a conventional serpentine type evaporator.

In the serpentine type evaporator which, as illustrated in FIG. 1, comprises a serpentine tube provided therein with a plurality of coolant conduits and corrugated in a zigzag pattern, fins interposed between opposed outer surfaces of the serpentine tube, an inlet side header pipe connected to one end of the serpentine tube so as to communicate with the coolant conduits, and an outlet side header pipe connected to the other end of the serpentine tube so as to communicate with the coolant conduits, for example, this invention provides the improvement which comprises a closing end plate 16 fitted to one end of the aforementioned outlet side header pipe 15 to close the end mentioned above and a projection 17 formed on the aforementioned closing end plate 16 and extended in the axial direction of the aforementioned outlet side header pipe 15. This projection 17 may be a solid body or a hollow body. Although this projection is desired to be disposed so that the axis thereof will coincide with the axis of the aforementioned outlet side header pipe 15, these two axes may deviate slightly from each other. The length of this projection 17 may be such that the leading end of the projection will reach the middle part of the entire length of the outlet side header pipe 15. Otherwise, it may be shorter as illustrated in FIG. 4. Generally, the length is about 3 to 42%, preferably about 3 to 20%, of the entire length of the outlet side header pipe 15. The diameter of the projection 17 is 5 to 50%, preferably 20 to 30%, of the inside diameter of the outlet side header pipe 15. Although the cross section of the projection 17 is desired to be circular, it may be elliptical, octagonal or hexagonal.

In the construction described above, when the coolant flows from the coolant conduits of the serpentine tube 11 into the outlet side header pipe 15, the projection 17 curbs the occurrence of standing current. Consequently, the vibration of the edge portion of the terminal of the serpentine tube 11 caused by the standing current ceases to exist and the occurrrence of resonance noise is prevented.

Since the serpentine type evaporator of the present invention is provided inside the outlet side header pipe with the projection, it prevents the occurrence of resonance noise. In a vehicle incorporating an automotive air-conditioning system, for example, the improved shaped tube evaporator of this invention prevents occurrence of noise within the vehicle interior.

What is claimed is:

1. In a serpentine type evaporator comprising a serpentine tube provided therein with a plurality of coolant conduits and corrugated in a zigzag pattern, fins interposed between opposed outer surfaces of said serpentine tube, an inlet side header pipe connected to one end of said serpentine tube so as to communicate with said coolant conduits, and an outlet side header pipe connected to the other end of said serpentine tube so as to communicate with said coolant conduits, said outlet side header pipe being essentially normal to said serpentine tube and having one end closed, whereby the coolant discharged from said serpentine tube is directed laterally away from said closed end, the improvement which comprises;

means disposed within the outlet side header pipe which prevents the formation of a standing current in the neighborhood of the closed end.

2. A serpentine type evaporator according to claim 1, wherein said projection is extended in the axial direction of said outlet side header pipe.

3. A serpentine type evaporator according to claim 2, wherein said projection is disposed coaxially with said oulet side header pipe.

4. A serpentine type evaporator according to claim 2, wherein the length of said projection is 3 to 20% of the entire length of said outlet side header pipe.

5. A serpentine type evaporator according to claim 2, wherein the cross section of said projection is in a circular shape.

6. A serpentine type evaporator according to claim 2, wherein the diameter of said projection is 20 to 30% of the inside diameter of said outlet side header pipe.

7. A serpentine type evaporator according to claim 1, wherein said means comprises a projection within the outlet side header pipe in the neighborhood of the closed end.

* * * * *

UNITED STATES PATENT AND TRADEMARK OFFICE

CERTIFICATE OF CORRECTION

PATENT NO. : 4,557,324

DATED : December 10, 1985

INVENTOR(S) : Hiroshi Kondo, Hiroyasu Nadamoto and Yoshikazu Takamatsu

It is certified that error appears in the above-identified patent and that said Letters Patent is hereby corrected as shown below:

Title Page, [22] Filed:; "Aug. 6, 1983" should read -- Aug. 6, 1984 --

Col. 4, line 7; "claim 1," should read -- claim 7, --

Signed and Sealed this

*Eighth* Day of *April 1986*

[SEAL]

*Attest:*

DONALD J. QUIGG

*Attesting Officer*

*Commissioner of Patents and Trademarks*